US008833321B2

(12) United States Patent
Sands et al.

(10) Patent No.: US 8,833,321 B2
(45) Date of Patent: Sep. 16, 2014

(54) CYLINDER HEAD COVER MODULE WITH INTEGRATED VALVE TRAIN

(75) Inventors: Richard H. Sands, Holly, MI (US); Alan G. Falkowski, Lake Orion, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 248 days.

(21) Appl. No.: 12/984,808

(22) Filed: Jan. 5, 2011

(65) Prior Publication Data

US 2012/0167845 A1 Jul. 5, 2012

(51) Int. Cl.

| | |
|---|---|
| ***F01M 9/10*** | (2006.01) |
| ***F02F 7/00*** | (2006.01) |
| ***F01L 9/02*** | (2006.01) |
| ***F01L 1/053*** | (2006.01) |
| *F01L 13/00* | (2006.01) |
| *F01L 1/047* | (2006.01) |
| *F01L 1/344* | (2006.01) |

(52) U.S. Cl.

CPC ..... *F02F 7/006* (2013.01); *F01L 2013/0052* (2013.01); *F01L 2101/00* (2013.01); *F01L 2001/0476* (2013.01); *F01L 9/02* (2013.01); *F01L 2001/34433* (2013.01); *F01L 1/053* (2013.01)

USPC ..... 123/90.38; 123/195 C

(58) Field of Classification Search

USPC ..... 123/90.1, 90.12, 90.13, 90.33, 90.38, 123/195 C, 196 M

See application file for complete search history.

(56) References Cited

U.S. PATENT DOCUMENTS

| | | | | |
|---|---|---|---|---|
| 4,887,562 | A * | 12/1989 | Wakeman | 123/90.12 |
| 6,601,553 | B1 * | 8/2003 | Vattaneo et al. | 123/90.15 |
| 6,860,010 | B2 | 3/2005 | Jones et al. | |
| 7,341,033 | B2 * | 3/2008 | Yoshijima et al. | 123/90.38 |
| 7,513,226 | B2 * | 4/2009 | Swain et al. | 123/90.12 |
| 7,536,987 | B2 * | 5/2009 | Yoshijima et al. | 123/90.33 |
| D632,305 | S * | 2/2011 | Sargeant | D15/5 |
| 8,256,395 | B2 * | 9/2012 | Smith et al. | 123/195 C |
| 2007/0012271 | A1 * | 1/2007 | Hilpert | 123/90.38 |
| 2009/0038579 | A1 * | 2/2009 | Shieh et al. | 123/195 C |
| 2010/0059013 | A1 * | 3/2010 | Narayanakumar et al. | 123/195 C |
| 2011/0000456 | A1 * | 1/2011 | Smith et al. | 123/195 C |
| 2011/0155084 | A1 * | 6/2011 | Sargeant | 123/90.15 |

FOREIGN PATENT DOCUMENTS

| | | | |
|---|---|---|---|
| EP | 1662097 | A1 | 5/2006 |
| GB | 303031 | A | 3/1930 |

* cited by examiner

*Primary Examiner* — Thomas Denion
*Assistant Examiner* — Daniel Berstein
(74) *Attorney, Agent, or Firm* — Ralph E Smith

(57) ABSTRACT

An internal combustion engine includes a cylinder block, a cylinder head and a cylinder head cover module attached to the cylinder head. The cylinder head cover module includes passageways and a plurality of receiving features for valve train components. A housing may be integrally formed with the cylinder head cover module. The cylinder head cover module may include components of a non-integrated valve control system and may be used in either an inline or a V-shaped engine.

10 Claims, 8 Drawing Sheets

CYLINDER HEAD COVER MODULE WITH INTEGRATED VALVE TRAIN

FIELD

The technology herein relates generally to multiple-cylinder internal combustion engines and more particularly to hydraulically-actuated valve train assemblies in such engines.

BACKGROUND

The core of a vehicle's internal combustion engine is its cylinders. Combustion of gases and other combustion materials occurs within the cylinders and effectuates the movement of pistons whose power is transferred to the vehicle's driveshaft. The cylinders each include multiple valves that allow the various combustion products and exhaust into and out of the combustion chamber. The proper operation of these valves is crucial to provide the appropriate mix of combustion products at the appropriate times in the combustion chambers in order to produce optimal power from the engine.

Historically, the cylinders were completely encased in an engine block. The engine block was a machined casting that included not only the cylinders and their components but also coolant passages and other necessary engine parts. The engine block was usually made of cast iron and was designed to be strong and to also provide a housing that prevented the leakage of products into or out of the combustion chambers. Because of the importance of avoiding leaks into and out of the combustion chambers, and because of the need for a strong casing, the engine block was manufactured as a single complex unit.

More recently, however, advancements in manufacturing have allowed for the use of a cylinder block with cylinders capped by a separate cylinder head. The cylinder head is mounted onto the cylinder block and often includes a portion of the combustion chamber for each cylinder. The cylinder head may also include openings to allow the combustion products into the combustion chambers. Because the cylinders in a vehicle engine are often arranged adjacent each other, the cylinder head usually consists of a single plate of metal that includes the various combustion chamber components and openings for multiple cylinders in the engine. The cylinder head is often made of aluminum strengthened by nickel.

The openings in the cylinder head that allow the combustion products into the combustion chambers and exhaust out of the chambers are regulated by intake and exhaust valves. Operation of the intake and exhaust valves is facilitated by an electro-mechanical system referred to as a valve train. A valve train generally includes the valves themselves and also various hydraulically-actuated devices for opening and closing the valves such as rocker arms, pushrods, lifters and camshafts. In a non-integrated valve train, for example, the hydraulic devices are electronically controlled. In many implementations, parts of the electronically-controlled hydraulic device are housed in a single "brick" structure. The brick structure includes many of the elements making up the electronically-controlled hydraulic device for the variable operation of the intake and exhaust valves, as well as all the ducts of the hydraulic system associated with that device. The brick often includes an aluminum housing that is secured onto the top of the cylinder head.

A cover may be used in order to enclose and protect the brick and cylinder head. The cover also prevents the leakage of oil from the brick and cylinder head to the exterior engine compartment. Historically, the cover's functions were primarily passive, with no active role being played by the cover. The cover may be made of aluminum or plastic.

The manufacturing requirements of producing and assembling a separate cylinder head, brick and cover result in a complex, expensive process that requires fitting and sealing together multiple parts. To avoid oil leakage, a tight seal is required between the multiple parts. Additionally, the cylinder head, brick and cover stack use a significant amount of the engine space available in a vehicle. Accordingly, there is a desire to reduce the complexities and size of the cylinder head, brick and cover stack.

SUMMARY

In various example embodiments, the technology described herein provides an internal combustion engine with a cylinder head cover module. An internal combustion engine includes a cylinder block, a cylinder head and a cylinder head cover module attached to the cylinder head. The cylinder head cover module includes passageways and a plurality of receiving features for valve train components. A housing may be integrally formed with the cylinder head cover module to include passageways and/or one or more receiving features for valve train components. The cylinder head cover module may include components of a non-integrated valve train such as a valve control system and may be used in both inline and V-shaped engines.

In another embodiment, a cylinder head cover module is disclosed. The cover module includes a housing having passageways for hydraulically-actuated valves.

In an additional embodiment, a vehicle engine is disclosed with one or more cylinder blocks that each includes a plurality of cylinders. The vehicle engine also includes a cylinder head mounted onto each of the cylinder blocks. The cylinder head encloses the plurality of cylinders. A cylinder head cover module is also attached to each of the cylinder heads. The cylinder head cover module includes a housing for a plurality of hydraulically-actuated valves.

In yet another embodiment, a method of assembling an internal combustion engine for a vehicle is disclosed. In the method, a cylinder head is attached to a cylinder block, the cylinder block being coupled to a drive train. A cylinder head cover module is attached to the cylinder head, wherein the cylinder head cover module includes a housing for a plurality of hydraulically-actuated valves and is electronically coupled to a valve control system.

Further areas of applicability of the present disclosure will become apparent from the detailed description and claims provided hereinafter. It should be understood that the detailed description, including disclosed embodiments and drawings, are merely exemplary in nature intended for purposes of illustration only and are not intended to limit the scope of the invention, its application or use. Thus, variations that do not depart from the gist of the invention are intended to be within the scope of the invention.

DETAILED DESCRIPTION

To reduce the assembly and sealing complexities, and to more effectively use the cylinder head cover and available engine space, the brick and the cylinder head cover may be integrated together into a single unit, cylinder head cover module. The integrated module results in fewer valve train components to be assembled and sealed together and a smaller vertical profile.

Without integration, the brick generally includes one or more of the following components: solenoids, check valves, valve actuators, a hydraulic pump, pump actuator arm, pump actuator arm pivot, accumulation chamber, pump return spring, oil temperature sensor and a factory oil fill port. The integrated module, therefore, may include each of the identified brick components in addition to other components more generally associated with a cylinder head cover, for example. Various embodiments of the integrated module include passageways for the flow of fluids therein and receiving features configured to hold, orient, and/or lock a variety of valve train components. Additional valve train components that may be integrated into the cover module include an oil filter, oil fill housing, one or more cam position sensors, a head cover gasket, a low pressure oil reservoir gasket and service and installations screws.

Figure 1:
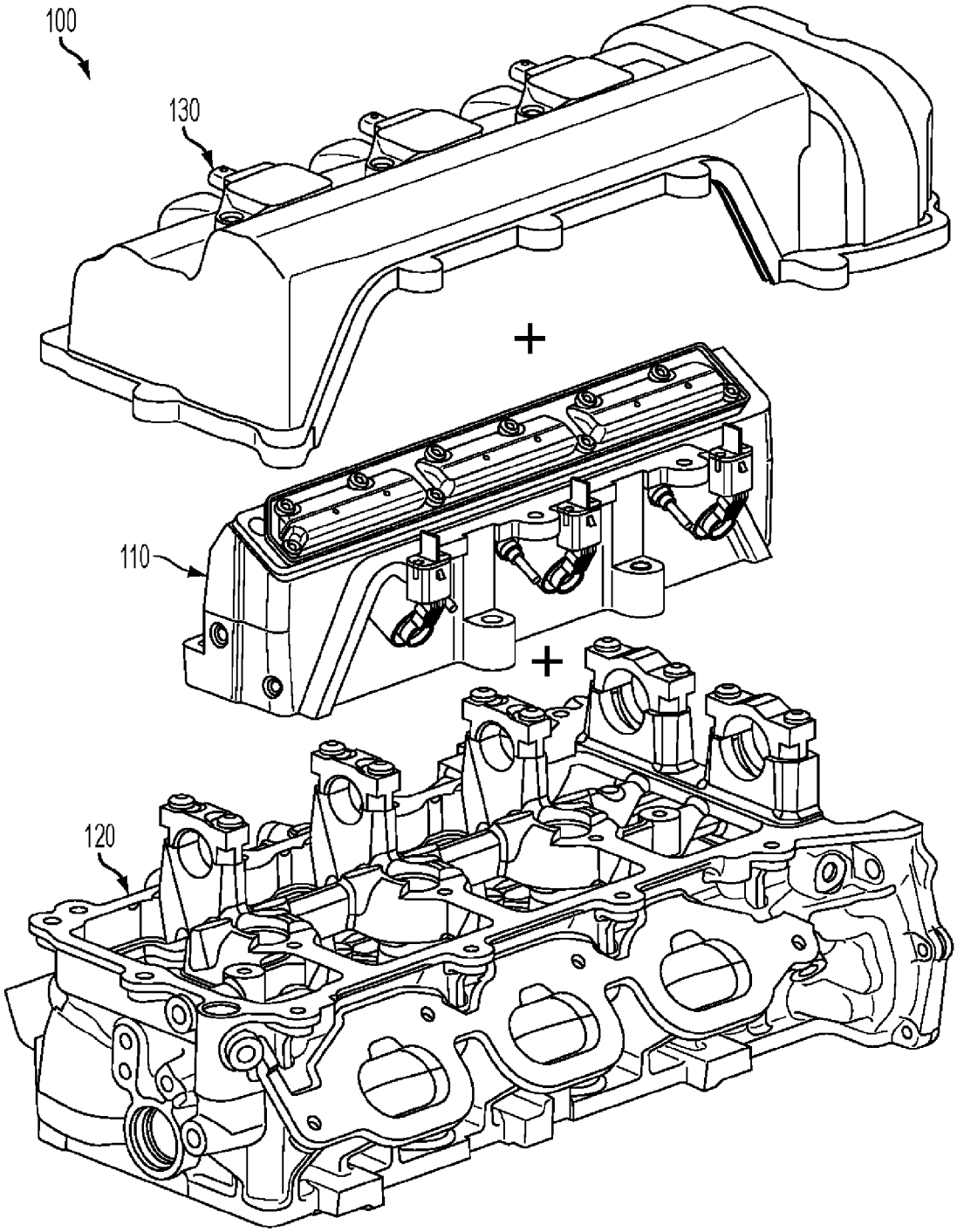
FIG. 1 illustrates a traditional assembly of a cylinder head, brick and cover.

FIG. 1 illustrates a traditional cylinder head, brick and cover assembly 100. The brick 110 is designed to attach and seal to the cylinder head 120. The cover 130 is designed to also attach to the cylinder head 120 and to completely seal and protect the combined cylinder head and brick assembly 100. The cylinder head 120 includes modifications that are required to attach to both the brick 110 and the cover 130. Because different vehicles have different height limitations with respect to the vehicle engine compartments, various bricks and covers have been designed to conform to various height constraints. This often results in the need to also modify the cylinder head 120.

Figure 2:
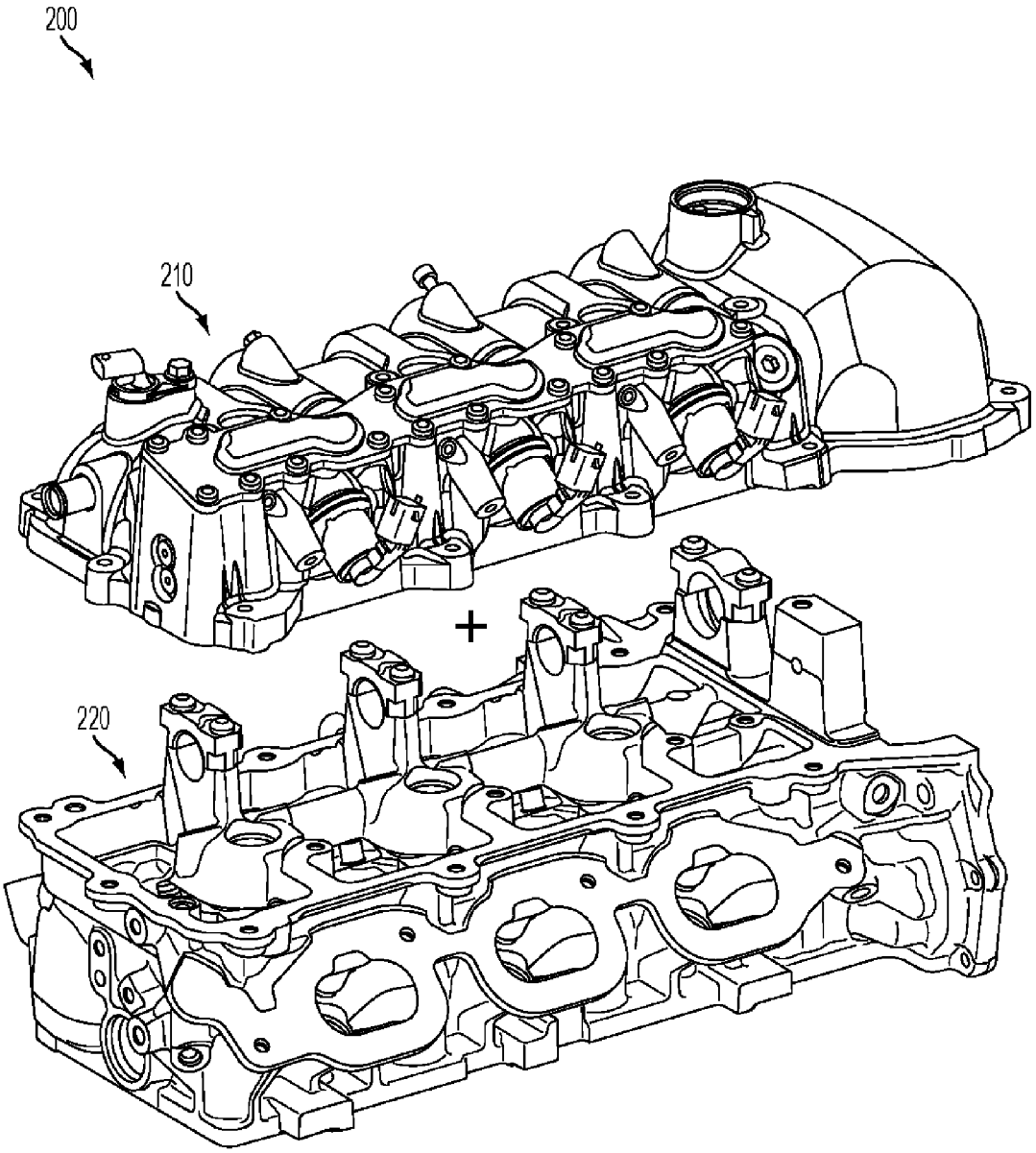
FIG. 2 illustrates a cylinder head and cover module assembly according to a disclosed embodiment.

In FIG. 2, however, the brick and cover have been combined into an integrated cover module 210, which is then attached to a cylinder head 220 to form a cover module and cylinder head assembly 200 in accordance with an embodiment disclosed herein. The cover module 210 seals to the cylinder head 220. Thus, the number of components required to be attached and sealed to the cylinder head 220 is reduced. Additionally, the complexity of assembly is also reduced. The integrated cover module 210 has a lower vertical profile than the profile resulting from the separate assembly of brick and cover. The lower vertical profile allows the cover module 210 to be used in a wider variety of vehicles, as the smaller cover module 210 is not as constrained by space as the non-integrated assembly. The resulting standardization of the cover modules 210 also results in the cylinder head 220 requiring fewer modifications to attach to the cover module 210.

Figure 3A:
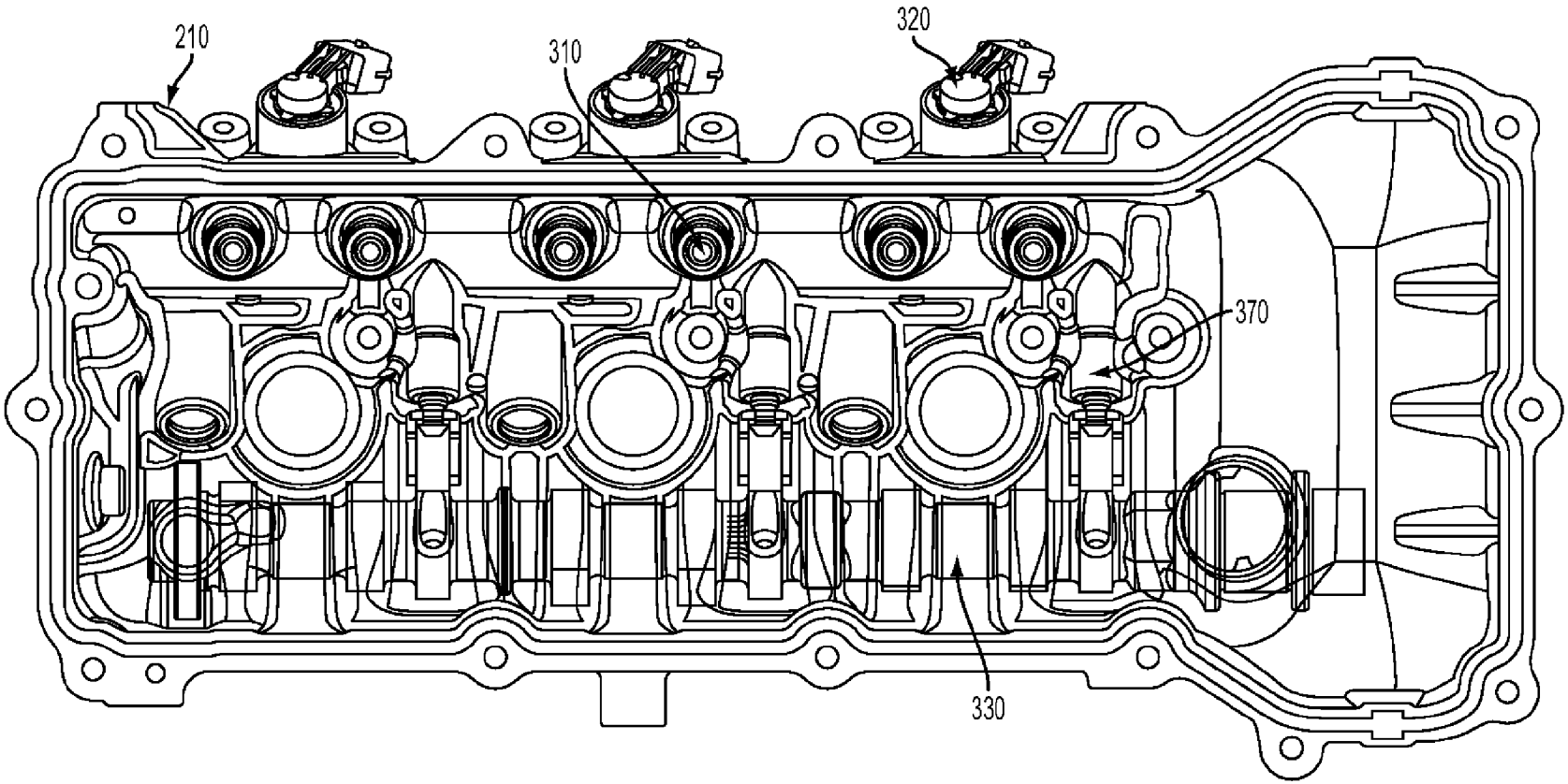
FIGS. 3A and 3B illustrate a cover module assembly according to a disclosed embodiment.
Figure 3B:
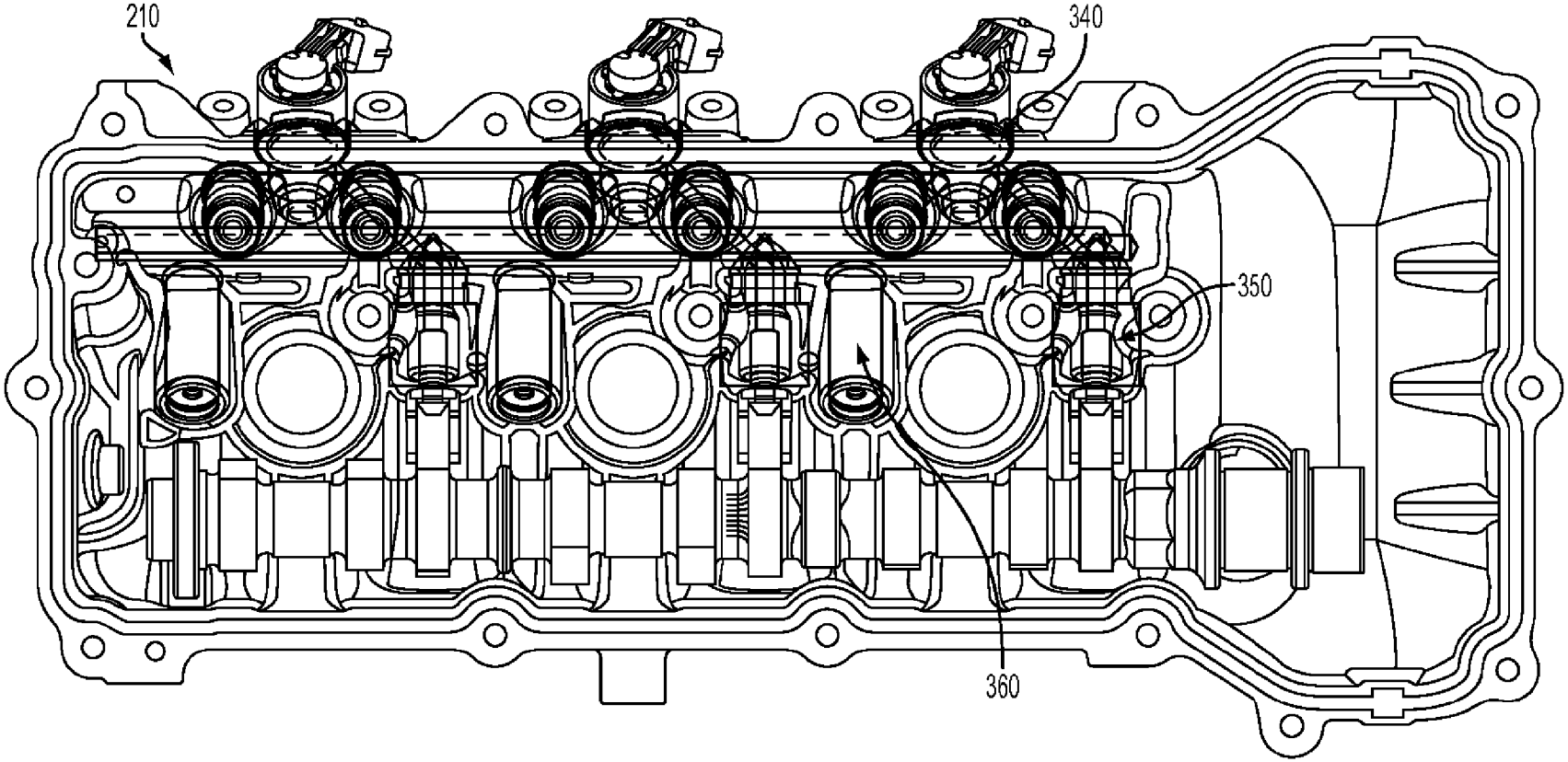

As described above, the cover module 210 includes components normally associated with a brick. For example, in FIG. 3A, cover module 210 is illustrated as including a hydraulic cylinder 310, a solenoid 320, a pump 370. In alternative embodiment, the cover module 210 can include a cam shaft 330, as shown in FIG. 3A. Additionally, cover module 210 includes hydraulic passageways that are aligned with an associated cylinder head 220 so as to enable operation of the functions normally associated with a brick. For example, as illustrated in FIG. 3B, cover module 210 may include hydraulic passageways and receiving features such as, for example, grooves, cavities, indentations, holes and protrusions that may be used to receive, orient and/or lock components normally associated with a brick. In FIG. 3B, the cover module 210 includes a pocket receiving feature 340 for the solenoid 320, a pump receiving feature 350 and hydraulic accumulators 360. In some embodiments, the module will include the passageways and receiving features. In other embodiments the module will include a housing portion having passageways for the flow of fluids therein and/or one or more of the receiving features. In some embodiments, the housing portion will be formed integrally with the module. Depending on the particular design configuration and manufacturing methods, a module may include a separate housing portion that may have some or all passageways and receiving features where another portion of the module may include other passageways and/or receiving features.

The reduction in the number of parts required in the cylinder assembly results in cost savings and an overall reduction in complexity. Fewer components generally results in fewer assembly-related problems or errors made during assembly. A reduction in components generally results in a reduction in investment for machining costs. Additional cost savings are realized through the reduced need to modify the cylinder head.

Figure 4:
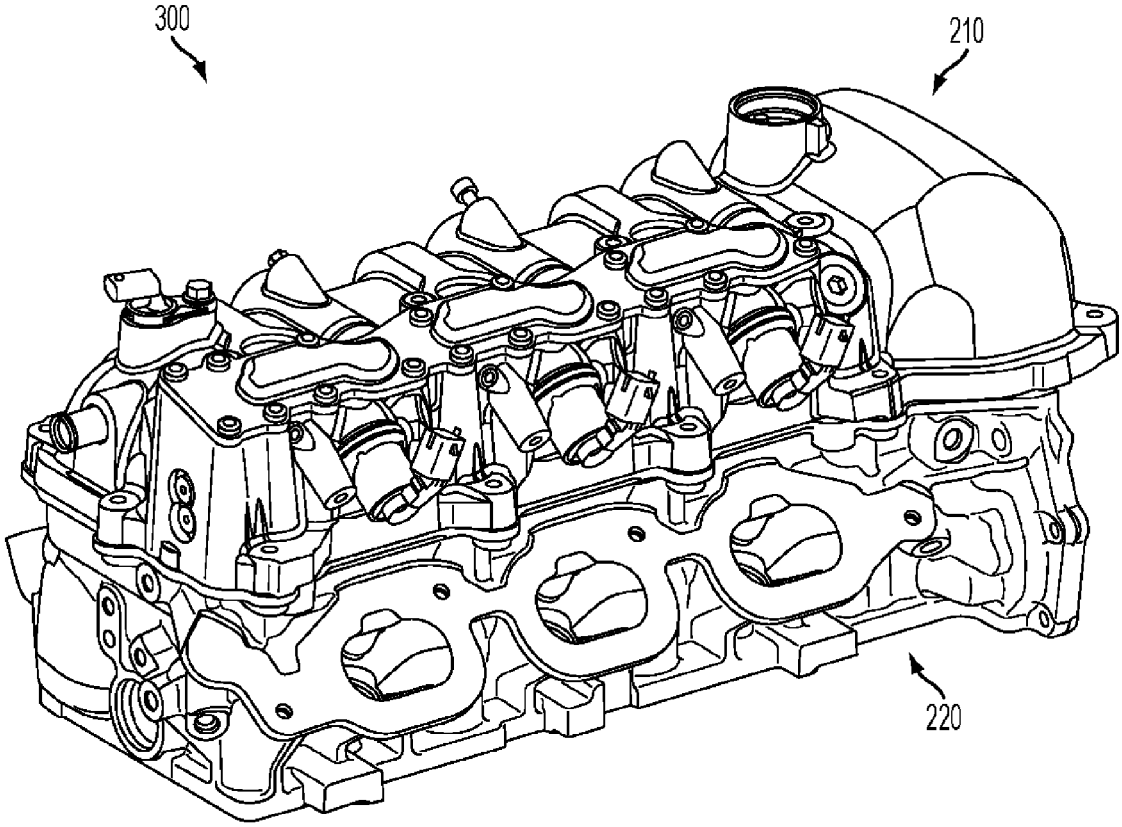
FIG. 4 illustrates a cylinder head and cover module assembly according to a disclosed embodiment.

FIG. 4 illustrates a combined cylinder head 220 and cover module 210 assembly 300. The cover module 210 includes the integrated brick with all of the brick's functions. Typical functions of the brick include operation of the solenoids, check valves, valve actuators and hydraulic pump. In the present disclosure, however, the solenoid, check valve, valve actuator and hydraulic pump operation occurs within the cover module 210. Thus, the cover module 210 is not simply a passive component, but is instead a component with moving parts that contributes to the function of the valve train. For example, in a non-integrated valve system, the cover module 210 will include cams and electronics for regulating the opening and closing of the valves. In other valve systems, other mechanical and/or electrical components may be included within the cover module 210.

The cover module 210 may be made using aluminum casting methods that result in low porosity. Semi-solid casting processes may be used that include the injection of solids and other methods to reduce the porosity of the cover module. Other casting methods that may be used include sand casting and permanent mold casting.

Figure 5A:
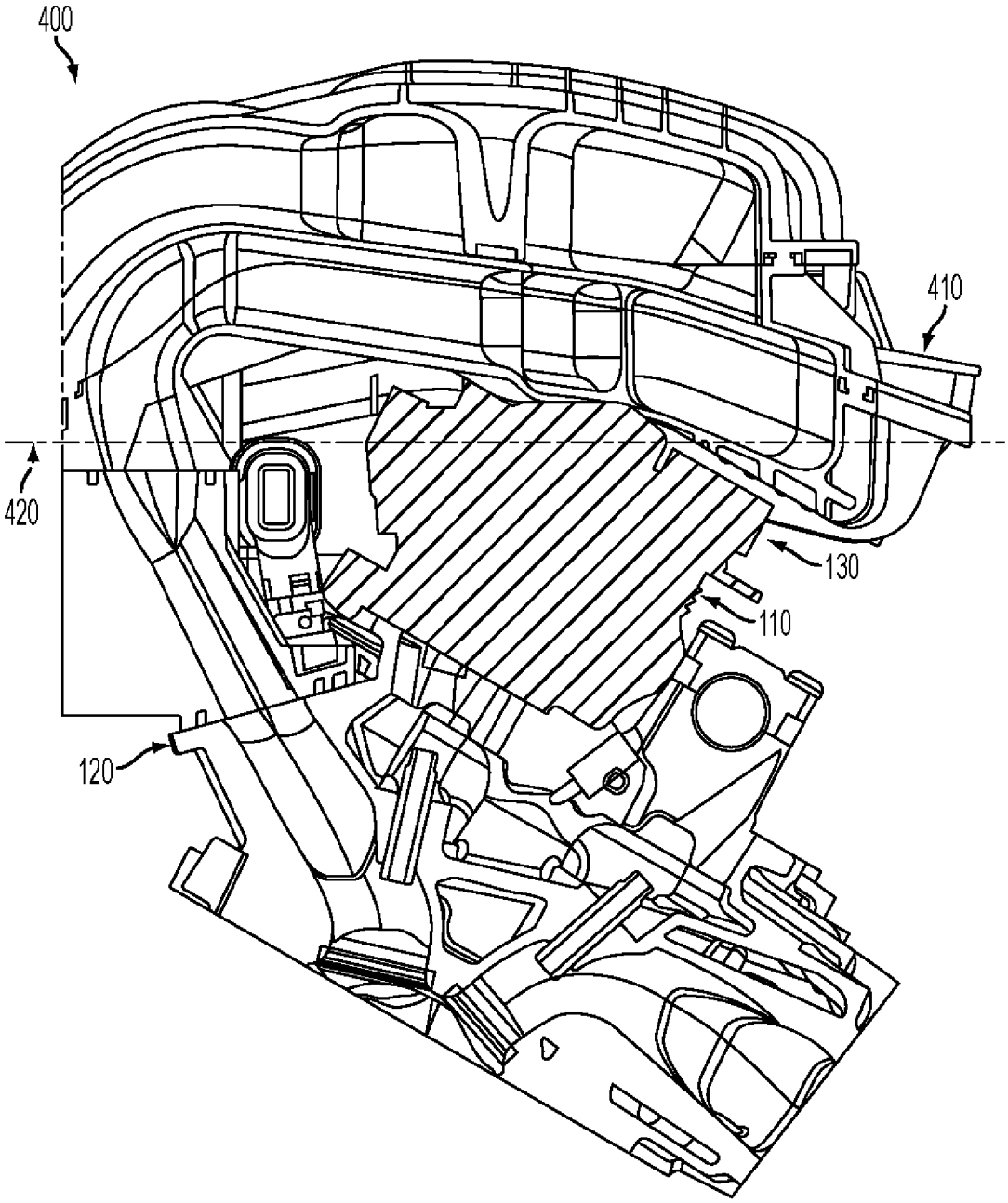
FIGS. 5A and 5B illustrate a portion of a V-shaped engine with a cylinder head and brick assembly.
Figure 5B:
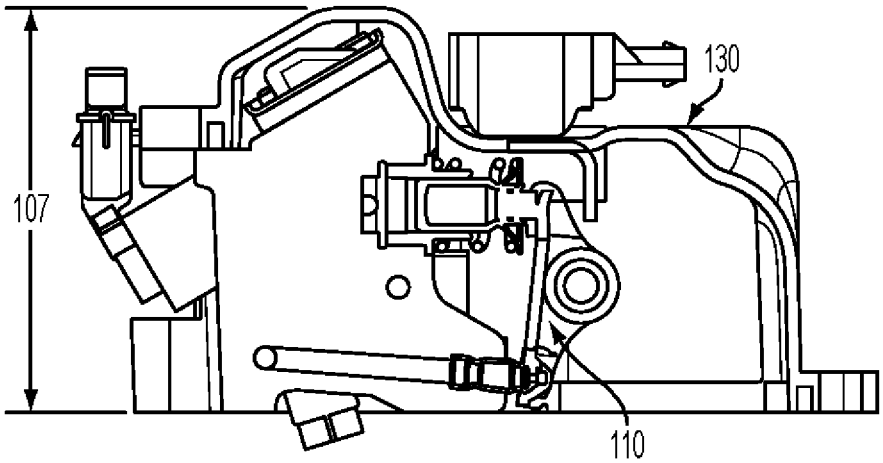
Figure 6B:
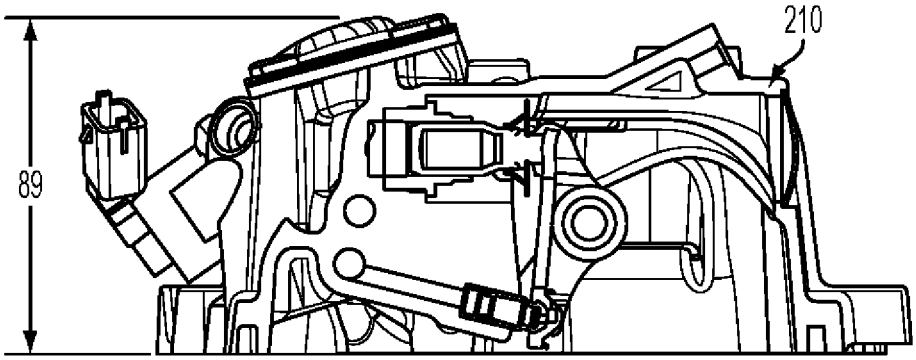
FIGS. 6A and 6B illustrate a portion of a V-shaped engine with a cylinder head and cover module assembly according to a disclosed embodiment.
Figure 6A:
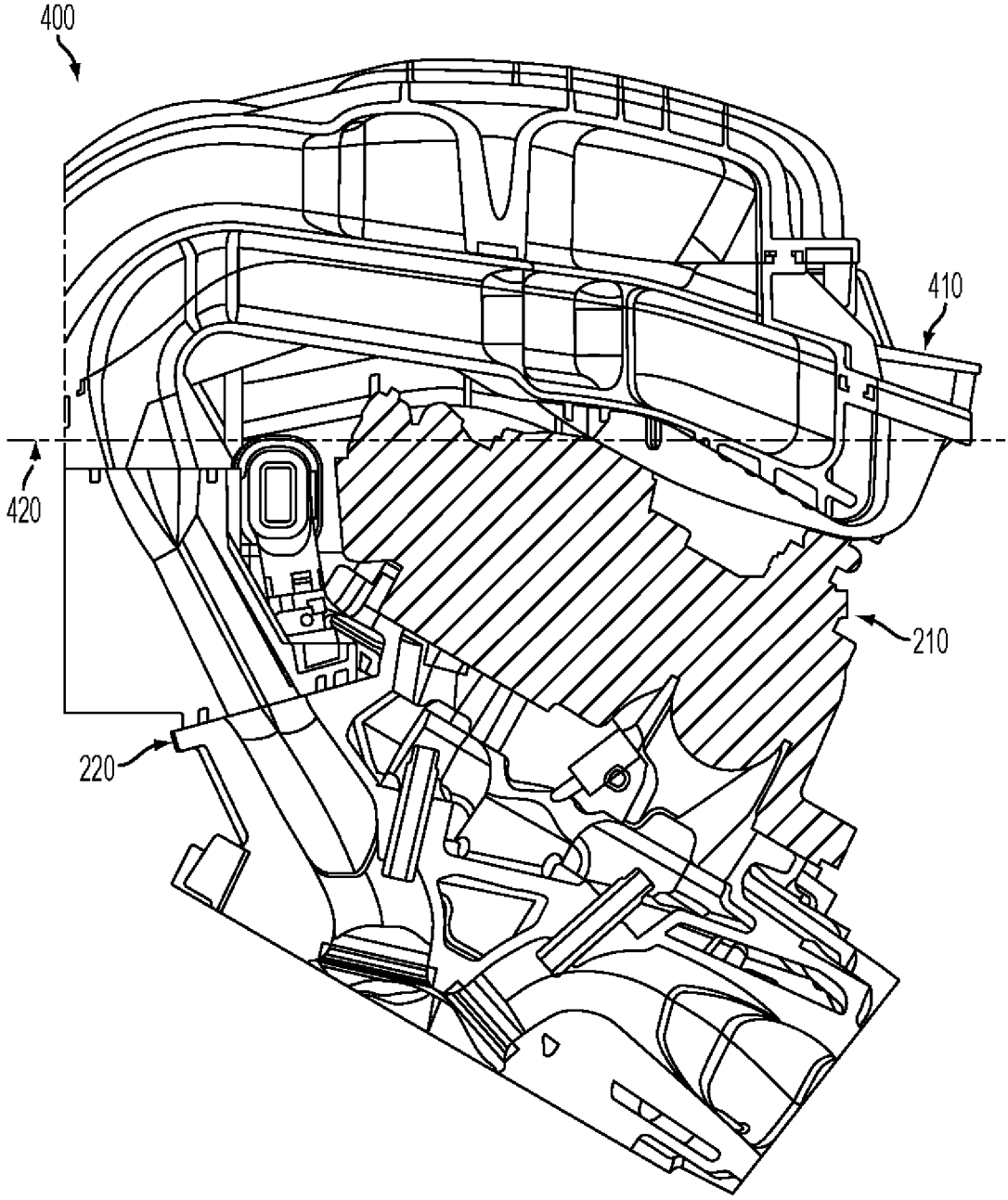

The space-saving benefits of the disclosed cover module allow the cover module to be used in V-shaped engines. V-shaped engines (for example, a V-6 or V-8 engine) include a V-shaped portion that significantly constrains the amount of vertical space available above the cylinder heads. For example, FIG. 5A illustrates a portion 400 of a V-shaped engine. The illustrated portion 400 includes a conventional cylinder head 120 and a typical brick 110 with cover 130. Note that there is very little space available between the brick 110 and cover 130 and an overlying manifold 410 for a separate cylinder head cover. FIG. 5B illustrates the conventional brick 110 and cover 130 combination and demonstrates that the combined height of the brick 110 and cover 130 combination is 107 cm (from a mounting plane of the cylinder head 120 to the top of the cover 130). FIG. 6A, in contrast, illustrates the same portion 400 of a V-shaped engine with the disclosed cover module 210 mounted on top of the cylinder head 220. A horizontal line 420 in both FIGS. 5A and 6A indicates the same height in both engines, from the crankshaft centerline to the top of the cylinder head cover. While the brick 110 and cover 130 in FIG. 5A rises above the horizontal line 420 and leaves little to no extra room, the cover module 210 in FIG. 6A only rises above the horizontal line 420 in just two locations and demonstrates an overall space savings. In FIG. 6B, the cover module 210 is illustrated to only have a height of 89 cm (from the mounting plane of the cylinder head 220 to the top of the cover module 210). Thus, as a result of this space savings, the disclosed cover module 210 enables the use of hitherto unusable valve control systems in V-shaped engines.

What is claimed is:

1. A cylinder head cover module, comprising:

a cover unit integrally formed with a valve train housing, the combined cover unit and valve train housing adapted to be attached to a cylinder head as a cylinder head cover module, the cylinder head cover module having a plurality of receiving features for valve train components and also including at least one each of a hydraulic cylinder, a solenoid, a pump, and a cam shaft, wherein the cylinder head cover module has a vertical profile measured from a mounting plane of the cylinder head to a top of the cover unit that is shorter than 107 cm.

2. The cylinder head cover module of claim 1, wherein the cylinder head cover module is adapted to be sealed to the cylinder head.

3. The cylinder head cover module of claim 1, wherein the valve train housing includes a plurality of passageways for hydraulically-actuated valves.

4. A vehicle engine, comprising:

one or more cylinder blocks that each include a plurality of cylinders;

a cylinder head mounted onto each cylinder block and enclosing the plurality of cylinders; and a cylinder head cover module attached to each of the cylinder heads, the cylinder head cover module including a cover unit integrally formed with a valve train housing and having a plurality of receiving features for valve train components and also including a hydraulic cylinder, a solenoid, a pump and a cam shaft.

5. The vehicle engine of claim 4, wherein each cylinder head cover module is sealed to a corresponding cylinder head.

6. The vehicle engine of claim 4, wherein the cylinder head cover module houses components of a non-integrated valve control system.

7. The vehicle engine of claim 6, wherein the vehicle engine is a V-shaped engine.

8. The vehicle engine of claim 6, wherein the vehicle engine is an inline engine.

9. The vehicle engine of claim 4, wherein the valve train housing includes a plurality of passageways for hydraulically-actuated valves.

10. The vehicle engine of claim 4, wherein the corresponding non-integrally-formed valve train housing and cylinder head cover has a vertical profile of 107 cm.

* * * * *